US005597789A

United States Patent [19]

Sadlowski

[11] Patent Number: 5,597,789

[45] Date of Patent: *Jan. 28, 1997

[54] LIQUID OR GRANULAR AUTOMATIC DISHWASHING DETERGENT COMPOSITIONS CONTAINING SILICATE AND LOW MOLECULAR WEIGHT MODIFIED POLYACRYLATE COPLOYMERS

[75] Inventor: Eugene S. Sadlowski, Cincinnati, Ohio

[73] Assignee: The Procter & Gamble Company, Cincinnati, Ohio

[ * ] Notice: The term of this patent shall not extend beyond the expiration date of Pat. No. 5,591,703.

[21] Appl. No.: 469,740

[22] Filed: Jun. 6, 1995

Related U.S. Application Data

[63] Continuation of Ser. No. 344,400, Nov. 23, 1994, abandoned, which is a continuation of Ser. No. 172,630, Dec. 23, 1993, abandoned, which is a continuation-in-part of Ser. No. 53,619, Apr. 27, 1993, abandoned.

[51] Int. Cl.[6] ..... C11D 3/37; C11D 3/36; C11D 7/14; C11D 7/36

[52] U.S. Cl. ..... 510/230; 510/226; 510/228; 510/229; 510/232; 510/233; 510/374; 510/375; 510/379; 510/444

[58] Field of Search ..... 252/174.24, 135, 252/99, 174.12, 174.4, 174.19, DIG. 2, DIG. 11, DIG. 12, DIG. 14

[56] References Cited

U.S. PATENT DOCUMENTS

| | | | |
|---|---|---|---|
| 3,579,455 | 4/1971 | Sabatelli | 252/135 |
| 4,203,858 | 5/1980 | Chakrabarti | 252/135 |
| 4,314,044 | 2/1982 | Hughes et al. | 260/29.6 M |
| 4,359,564 | 11/1982 | Merritt et al. | 526/260 |
| 4,530,766 | 7/1985 | Hann et al. | 210/701 |
| 4,568,476 | 2/1986 | Kielman et al. | 252/95 |
| 4,597,886 | 7/1986 | Goedhart et al. | 252/95 |
| 4,620,936 | 11/1986 | Kielman et al. | 252/99 |
| 4,917,813 | 4/1990 | Aoyagi et al. | 252/99 |
| 5,066,415 | 11/1991 | Dany et al. | 252/135 |
| 5,071,895 | 12/1991 | Hughes et al. | 526/210 |
| 5,084,535 | 1/1992 | Hennig et al. | 526/211 |
| 5,098,590 | 3/1992 | Dixit et al. | 252/99 |
| 5,112,518 | 5/1992 | Klugkist et al. | 252/174.12 |
| 5,126,069 | 6/1992 | Kud et al. | 252/174.23 |
| 5,152,910 | 10/1992 | Savio et al. | 252/95 |
| 5,152,911 | 10/1992 | Savio et al. | 252/95 |
| 5,169,553 | 12/1992 | Durbut et al. | 252/99 |
| 5,173,207 | 12/1992 | Drapier et al. | 252/99 |

FOREIGN PATENT DOCUMENTS

| | | |
|---|---|---|
| 0239379A2 | 9/1987 | European Pat. Off. . |
| 0364067 | 4/1990 | European Pat. Off. . |
| 0414197 | 2/1991 | European Pat. Off. . |
| 0429307A2 | 5/1991 | European Pat. Off. . |
| 0459661A1 | 12/1991 | European Pat. Off. . |
| 0504091A1 | 9/1992 | European Pat. Off. . |
| 0519603A1 | 12/1992 | European Pat. Off. . |
| 0308221A1 | 12/1992 | European Pat. Off. . |

*Primary Examiner*—Ardith Hertzog
*Attorney, Agent, or Firm*—Michael D. Jones; George W. Allen; Jerry J. Yetter

[57] ABSTRACT

Liquid or granular automatic dishwashing detergent compositions comprising silicate and low molecular weight polyacrylate copolymer exhibiting enhanced hard water filming performance.

14 Claims, No Drawings

LIQUID OR GRANULAR AUTOMATIC DISHWASHING DETERGENT COMPOSITIONS CONTAINING SILICATE AND LOW MOLECULAR WEIGHT MODIFIED POLYACRYLATE COPLOYMERS

REFERENCE TO RELATED APPLICATION

This is a continuation of application Ser. No. 08/344,400, filed on Nov. 23, 1994, now abandoned, which is a continuation of abandoned Ser. No. 08/172,630, filed on Dec. 23, 1993, which is a Continuation-In-Part of abandoned Ser. No. 08/053,619, filed on Apr. 27, 1993.

TECHNICAL FIELD

This invention is in the field of liquid and granular automatic dishwashing compositions. More specifically, the invention relates to compositions containing silicate and low molecular weight modified polyacrylate copolymers.

BACKGROUND OF THE INVENTION

Liquid and granular automatic dishwashing detergent components while necessary for various cleaning benefits, often can create other problems. For example, carbonate, and phosphate, conventional detergent ingredients, are known to contribute to formation of hard water film on glasses.

Organic dispersants can overcome the problem of unsightly films which form on china, especially on glassware, due to calcium- or magnesium-hardness- induced precipitation of pH-adjusting agents. However not all dispersants work as well on the various types of precipitation.

Although conventional low molecular weight polyacrylate homopolymers are satisfactory in the dispersion of insoluble calcium carbonate in automatic dishwashing detergent compositions, it has recently been found that low molecular weight modified polyacrylate copolymers enhance filming performance in automatic dishwashing detergent compositions containing silicate.

Not only do the low molecular weight modified polyacrylate copolymers of the present invention prevent hard water filming due to precipitation of silicate but it has also been surprisingly found that these modified polyacrylates show improved enzyme performance (i.e. bulk food removal) in enzyme containing automatic dishwashing detergent compositions.

SUMMARY OF THE INVENTION

The present invention encompasses a liquid or granular automatic dishwashing detergent composition comprising:

(a) from about 0.01% to about 40% alkali metal silicate; and (b) from about 0.1% to about 20% modified polyacrylate copolymer having a molecular weight of less than about 15,000.

A preferred liquid or granular automatic dishwashing detergent composition herein comprises enzyme and/or carbonate.

DETAILED DESCRIPTION OF THE INVENTION

The present invention is a liquid or granular automatic dishwashing detergent composition comprising:

(a) from about 0.01% to about 90% detergency builder;

(b) from about 0.1% to about 20% modified polyacrylate copolymer having a molecular weight less than about 15,000; and (c) from about 0.001% to about 5% detersive enzyme.

Compositions of the invention exhibit enhanced hard water filming performance and improved enzyme performance by the presence of low molecular weight modified polyacrylates.

SILICATE

The compositions of the type described herein deliver their bleach and alkalinity to the wash water very quickly. Accordingly, they can be aggressive to metals, dishware, and other materials, which can result in either discoloration by etching, chemical reaction, etc. or weight loss. The alkali metal silicates hereinafter described provide protection against corrosion of metals and against attack on dishware, including fine china and glassware.

The $SiO_2$ level in the composition of the present invention should be from about 0.01% to about 40%, preferably 4% to about 25%, more preferably from about 5% to about 20%, most preferably from about 6% to about 15%, based on the weight of the automatic dishwashing detergent composition. The ratio of $SiO_2$ to the alkali metal oxide ($M^2O$, where M=alkali metal) is typically from about 1 to about 3.2, preferably from about 1.6 to about 3, more preferably from about 2 to about 2.4. Preferably, the alkali metal silicate is hydrous, having from about 15% to about 25% water, more preferably, from about 17% to about 20%.

The highly alkaline metasilicates can be employed, although the less alkaline hydrous alkali metal silicates having a $SiO_2$:$M_2O$ ratio of from about 2.0 to about 2.4 are preferred. Anhydrous forms of the alkali metal silicates with a $SiO_2$:$M_2O$ ratio of 2.0 or more are less preferred because they tend to be significantly less soluble than the hydrous alkali metal silicates having the same ratio.

Sodium and potassium, and especially sodium, silicates are preferred. A particularly preferred alkali metal silicate is a granular hydrous sodium silicate having a $SiO_2$:$Na_2O$ ratio of from 2.0 to 2.4 available from PQ Corporation, named Britesil $H_2O$ and Britesil H24. Most preferred is a granular hydrous sodium silicate having a $SiO_2$:$Na_2O$ ratio of 2.0.

While typical forms, i.e. powder and granular, of hydrous silicate particles are suitable, preferred silicate particles have a mean particle size between about 300 and about 900 microns with less than 40% smaller than 150 microns and less than 5% larger than 1700 microns. Particularly preferred is a silicate particle with a mean particle size between about 400 and about 700 microns with less than 20% smaller than 150 microns and less than 1% larger than 1700 microns.

LOW MOLECULAR WEIGHT MODIFIED POLYACRYLATES

The present invention can contain from about 0.1% to about 20%, preferably from about 1% to about 10%, most preferably from about 3% to about 8%, by weight of the automatic dishwashing detergent composition, of low molecular weight modified polyacrylate copolymer.

The term modified polyacrylate is defined as a copolymer which contains as monomer units: a) from about 90% to about 10%, preferably from about 80% to about 20% by weight acrylic acid or its salts and b) from about 10% to about 90%, preferably from about 20% to about 80% by weight of a substituted acrylic monomer or its salts having the general formula:

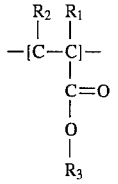

wherein at least one of the substituents $R_1$, $R_2$ or $R_3$, preferably $R_1$ or $R_2$ is a 1 to 4 carbon alkyl or hydroxyalkyl group; $R_1$ or $R_2$ can be a hydrogen and $R_3$ can be a hydrogen or alkali metal salt. Most preferred is a substituted acrylic monomer wherein $R_1$ is methyl, $R_2$ is hydrogen and $R_3$ is sodium.

The low molecular weight polyacrylate preferably has a molecular weight of less than about 15,000, preferably from about 500 to about 10,000, most preferably from about 1,000 to about 5,000. The most preferred modified polyacrylate copolymer has a molecular weight of 3500 and is about 70% by weight acrylic acid and about 30% by weight methyl acrylic acid.

Suitable modified polyacrylates include the low molecular weight copolymers of unsaturated aliphatic carboxylic acids as disclosed in U.S. Pat. Nos. 4,530,766, and 5,084,535, both of which are incorporated herein by reference.

DETERGENCY BUILDER

The detergency builders used can be any of the detergency builders known in the art, which include the various water-soluble, alkali metal, ammonium or substituted ammonium phosphates, polyphosphates, phosphonates, polyphosphonates, carbonates, bicarbonates, borates, polyhydroxysulfonates, polyacetates, carboxylates (e.g. citrates), and polycarboxylates. Preferred are the alkali metal, especially sodium, salts of the above and mixtures thereof.

The amount of builder is from about 0.01% to about 90%, preferably from about 15% to about 80%, most preferably from about 15% to about 75% by weight of the automatic dishwashing detergent composition.

Specific examples of inorganic phosphate builders are sodium and potassium tripolyphosphate, pyrophosphate, polymeric metaphosphate having a degree of polymerization of from about 6 to 21, and orthophosphate. Examples of polyphosphonate builders are the sodium and potassium salts of ethylene diphosphonic acid, the sodium and potassium salts of ethane 1-hydroxy-1, 1-diphosphonic acid and the sodium and potassium salts of ethane, 1,1,2-triphosphonic acid. A particularly preferred polyphosphonate builder component is ethane 1-hydroxy-1, 1 diphosphonic acid or its alkali metal salts, which demonstrates calcium carbonate crystal growth inhibition properties, present at a level of from about 0.01% to about 20%, preferably from about 0.1% to about 10%, most preferably from about 0.2% to about 5% by weight of the compositions. Other phosphorus builder compounds are disclosed in U.S. Pat. Nos. 3,159,581; 3,213,030; 3,422,021; 3,422,137, 3,400,176 and 3,400,148, incorporated herein by reference.

Examples of non-phosphorus, inorganic builders are sodium and potassium carbonate, bicarbonate, sesquicarbonate and hydroxide.

Water-soluble, non-phosphorus organic builders useful herein include the various alkali metal, ammonium and substituted ammonium polyacetates, carboxylates, polycarboxylates and polyhydroxysulfonates. Examples of polyacetate and polycarboxylate builders are the sodium, potassium, lithium, ammonium and substituted ammonium salts of ethylene diamine tetraacetic acid, nitrilotriacetic acid, tartrate monosuccinic acid, tartrate disuccinic acid, oxydisuccinic acid, carboxy methyloxysuccinic acid, mellitic acid, benzene polycarboxylic acids, and citric acid. The acidic form of these builders can also be used, preferably citric acid.

Preferred detergency builders have the ability to remove metal ions other than alkali metal ions from washing solutions by sequestration, which as defined herein includes chelation, or by precipitation reactions. Sodium tripolyphosphate is typically a particularly preferred detergency builder material because of its sequestering ability. Sodium citrate is also a particularly preferred detergency builder, particularly when it is desirable to reduce or eliminate the total phosphorus level of the compositions of the invention.

Particularly preferred automatic dishwashing detergent compositions of the invention contain, by weight of the automatic dishwashing detergent composition, from about 5% to about 40%, preferably from about 10% to about 30%, most preferably from about 15% to about 20%, of sodium carbonate. Particularly preferred as a replacement for the phosphate builder is sodium citrate with levels from about 5% to about 40%, preferably from about 7% to 35%, most preferably from about 8% to about 30%, by weight of the automatic dishwashing detergent composition.

Some of the above-described detergency builders additionally serve as buffering agents. It is preferred that the buffering agent contain at least one compound capable of additionally acting as a builder.

DETERSIVE ENZYME

The compositions of this invention may contain from about 0.001% to about 5%, more preferably from about 0.003% to about 4%, most preferably from about 0.005% to about 3%, by weight, of active detersive enzyme.

The preferred detersive enzyme is selected from the group consisting of protease, amylase, lipase and mixtures thereof. Most preferred are protease or amylase or mixtures thereof.

The proteolytic enzyme can be of animal, vegetable or microorganism (preferred) origin. More preferred is serine proteolytic enzyme of bacterial origin. Purified or nonpurified forms of this enzyme may be used. Proteolytic enzymes produced by chemically or genetically modified mutants are included by definition, as are close structural enzyme variants. Particularly preferred is bacterial serine proteolytic enzyme obtained from Bacillus, *Bacillus subtilis* and/or *Bacillus licheniformis*.

Suitable proteolytic enzymes include Alcalase®, Esperase®, Durazym®, Savinase® (preferred); Maxatase®, Maxacal® (preferred), and Maxapem® 15 (protein engineered Maxacal); Purafect® (preferred) and subtilisin BPN and BPN'; which are commercially available. Preferred proteolytic enzymes are also modified bacterial serine proteases, such as those described in European Patent Application Serial Number 87 303761.8, filed Apr. 28, 1987 (particularly pages 17, 24 and 98), and which is called herein "Protease B", and in European Patent Application 199,404, Venegas, published Oct. 29, 1986, which refers to a modified bacterial serine proteolytic enzyme which is called "Protease A" herein. Preferred proteolytic enzymes, then, are selected from the group consisting of Savinase®, Esperase®, Maxacal®, Purafect®, BPN', Protease A and Protease B, and mixtures thereof. Savinase® is most preferred.

Suitable lipases for use herein include those of bacterial, animal, and fungal origin, including those from chemically or genetically modified mutants.

Suitable bacterial lipases include those produced by Pseduomonas, such as *Pseudomonas stutzeri* ATCC 19.154, as disclosed in British Patent 1,372,034, incorporated herein by reference. Suitable lipases include those which show a positive immunological cross-reaction with the antibody of the lipase produced from the microorganism *Pseudomonas fluorescens* IAM 1057. This lipase and a method for its purification have been described in Japanese Patent Application 53-20487, laid open on Feb. 24, 1978, which is incorporated herein by reference. This lipase is available under the trade name Lipas P "Amano," hereinafter referred to as "Amano-P." Such lipases should show a positive immunological cross reaction with the Amano-P antibody, using the standard and well-known immunodiffusion procedure according to Oucheterlon (Acta. Med. Scan., 133, pages 76–79 (1950)). These lipases, and a method for their immunological cross-reaction with Amano-P, are also described in U.S. Pat. No. 4,707,291, Thom et al., issued Nov. 17, 1987, incorporated herein by reference. Typical examples thereof are the Amano-P lipase, the lipase ex *Pseudomonas fragi* FERM P 1339 (available under the trade name Amano-B), lipase ex *Pseudomonas nitroreducens* var. lipolyticum FERM P 1338 (available under the trade name Amano-CES), lipases ex *Chromobacter viscosum* var. lipolyticum NRR1b 3673, and further *Chromobacter viscousm* lipases, and lipases ex *Pseudomonas gladioli.* A preferred lipase is derived from *Pseudomonas pseudoalcaligenes,* which is described in Granted European Patent EP-B-0218272. Other lipases of interest are Amano AKG and *Bacillis Sp* lipase (e.g. Solvay enzymes).

Other lipases which are of interest where they are compatible with the composition are those described in EP A 0 339 681, published Nov. 28, 1990, EP A 0 385 401, published Sep. 5, 1990, EP A 0 218 272, published Apr. 15, 1987, and PCT/DK 88/00177, published May 18, 1989, all incorporated herein by reference.

Suitable fungal lipases include those produced by *Humicola lanuginosa* and *Thermomyces lanuginosus.* Most preferred is lipase obtained by cloning the gene from *Humicola lanuginosa* and expressing the gene in *Aspergillus oryzae* as described in European Patent Application 0 258 068, incorporated herein by reference, commercially available under the trade name Lipolase® from Novo-Nordisk.

Any amylase suitable for use in a dishwashing detergent composition can be used in these compositions. Amylases include for example, α-amylases obtained from a special strain of *B. licheniforms,* described in more detail in British Patent Specification No. 1,296,839. Amylolytic enzymes include, for example, Rapidase™, Maxamyl™, Termamyl™ and BAN™.

In a preferred embodiment, from about 0.001% to about 5%, preferably 0.005% to about 3%, by weight of active amylase can be used. Preferably from about 0.005% to about 3% by weight of active protease can be used. Preferably the amylase is Maxamyl™ and/or Termamyl™ and the protease is Savinase® and/or protease B.

DETERGENT SURFACTANTS

The compositions of this invention can contain from about 0.01% to about 40%, preferably from about 0.1% to about 30% of a detergent surfactant. In the preferred automatic dishwashing detergent compositions of the invention the detergent surfactant is most preferably low foaming by itself or in combination with other components (i.e. suds suppressors) is low foaming.

Compositions which are chlorine bleach free do not require the surfactant to be bleach stable. Similarly, those compositions containing enzymes, the surfactant employed is preferably enzyme stable (enzyme compatible) and free of enzymatically reactive species. For example, when proteases and amylases are employed, the surfactant should be free of peptide or glycosidic bonds.

Desirable detergent surfactants include nonionic, anionic, amphoteric and zwitterionic detergent surfactants, and mixtures thereof.

Examples of nonionic surfactants include:

(1) The condensation product of 1 mole of a saturated or unsaturated, straight or branched chain, alcohol of fatty acid containing from about 10 to about 20 carbon atoms with from about 4 to about 40 moles of ethylene oxide. Particularly preferred is the condensation product of a fatty alcohol containing from 17 to 19 carbon atoms, with from about 6 to about 15 moles, preferably 7 to 12 moles, most preferably 9 moles, of ethylene oxide provides superior spotting and filming performance. More particularly, it is desirable that the fatty alcohol contain 18 carbon atoms and be condensed with from about 7.5 to about 12, preferably about 9 moles of ethylene oxide. These various specific $C_{17}$–$C_{19}$ ethoxylates give extremely good performance even at lower levels (e.g., 2.5%–3%). At the higher levels (less than 5%), they are sufficiently low sudsing, especially when capped with a low molecular weight ($C_{1-5}$) acid or alcohol moiety, so as to minimize or eliminate the need for a suds-suppressing agent. Suds-suppressing agents in general tend to act as a load on the composition and to hurt long term spotting and filming characteristics.

(2) Polyethylene glycols or polypropylene glycols having molecular weight of from about 1,400 to about 30,000, e.g., 20,000; 9,500; 7,500; 7,500; 6,000; 4,500; 3,400; and 1,450. All of these materials are wax-like solids which melt between 110° F. (43° C.) and 200° F. (93° C.).

(3) The condensation products of 1 mole of alkyl phenol wherein the alkyl chain contains from about 8 to about 18 carbon atoms and from about 4 to about 50 moles of ethylene oxide.

(4) Polyoxypropylene, polyoxyethylene condensates having the to formula $HO(C_2H_6O)_x(C_3H_6O)_xH$ or $HO(C_3H_6O)_y(C_2H_4O)_x(C_3H_6O)_yH$ where total y equals at least 15 and total $(C_2H_4O)$ equals 20% to 90% of the total weight of the compound and the molecular weight is from about 2,000 to about 10,000, preferably from about 3,000 to about 6,000. These materials are, for example, the PLURONICS® from BASF which are well known in the art.

(5) the compounds of (1) and (4) which are capped with propylene oxide, butylene oxide and/or short chain alcohols and/or short chain fatty acids, e.g., those containing from 1 to about 5 carbon atoms, and mixtures thereof.

Useful surfactants in detergent compositions are those having the formula $RO\text{-}(C_2H_4O)_xR^1$ wherein R is an alkyl or alkylene group containing from 17 to 19 carbon atoms, x is a number from about 6 to about 15, preferably from about 7 to about 12, and $R^1$ is selected from the group consisting of: hydrogen, $C_{1-5}$ alkyl groups, $C_{2-5}$ acyl groups and groups having the formula $—(C_yH_{2y}O)_nH$ wherein y is 3 or 4 and n is a number from one to about 4.

Particularly suitable surfactants are the low-sudsing compounds of (4), the other compounds of (5), and the $C_{17}$–$C_{19}$ materials of (1) which have a narrow ethoxy distribution. Certain of the block co-polymer surfactant compounds designated PLURONIC®, PLURAFAC® and TETRONIC® by the BASF Corp., Parsippany, N.J. are suitable as the surfactant for use herein. A particularly preferred embodiment contains from about 40% to about 70% of a polyoxypropylene, polyoxethylene block polymer blend comprising about 75%, by weight of the blend, of a reverse block co-polymer of polyoxyethylene and polyoxypropylene containing 17 moles of ethylene oxide and 44 moles of propylene oxide; and about 25%, by weight of the blend, of a block co-polymer of polyoxyethylene and polyoxypropylene, initiated with tri-methylol propane, containing 99 moles of propylene oxide and 24 moles of ethylene oxide per mole of trimethylol propane.

Additional nonionic type surfactants which may be employed have melting points at or above ambient temperatures, such as octyldimethylamine N-oxide dihydrate, decyldimethylamine N-oxide dihydrate, $C_8$–$C_{12}$ N-methylglucamides and the like. Such surfactants may advantageously be blended in the instant compositions with short-chain anionic surfactants, such as sodium octyl sulfate and similar alkyl sulfates, though short-chain sulfonates such as sodium cumene sulfonate could also be used.

In addition to the above mentioned surfactants, other suitable surfactants for detergent compositions can be found in the disclosures of U.S. Pat. Nos. 3,544,473, 3,630,923, 3,88,781, 4,001,132, and 4,375,565 all of which are incorporated herein by reference.

Anionic surfactants which are suitable for the compositions of the present invention include, but are not limited to, water soluble-alkyl sulfates and/or sulfonates, containing from about 8 to about 18 carbon atoms. Natural fatty alcohols include those produced by reducing the glycerides of naturally occurring fats and oils. Fatty alcohols can be produced synthetically, for example, by the Oxo process. Examples of suitable alcohols which can be employed in alkyl sulfate manufacture include decyl, lauryl, myristyl, palmityl and stearyl alcohols and the mixtures of fatty alcohols derived by reducing the glycerides of tallow and coconut oil.

Specific examples of alkyl sulfate salts which can be employed in the instant detergent compositions include sodium lauryl alkyl sulfate, sodium stearyl alkyl sulfate, sodium palmityl alkyl sulfate, sodium decyl sulfate, sodium myristyl alkyl sulfate, potassium lauryl alkyl sulfate, potassium stearyl alkyl sulfate, potassium decyl sulfate, potassium palmityl alkyl sulfate, potassium myristyl alkyl sulfate, sodium dodecyl sulfate, potassium dodecyl sulfate, potassium tallow alkyl sulfate, sodium tallow alkyl sulfate, sodium coconut alkyl sulfate, magnesium coconut alkyl sulfate, calcium coconut alkyl sulfate, potassium coconut alkyl sulfate and mixtures thereof. Highly preferred alkyl sulfates are sodium coconut alkyl sulfate, potassium coconut alkyl sulfate, potassium lauryl alkyl sulfate and sodium lauryl alkyl sulfate.

A preferred sulfonated anionic surfactant is the alkali metal salt of secondary alkane sulfonates, an example of which is the Hostapur SAS from Hoechst Celanese.

Another class of surfactants operable in the present invention are the water-soluble betaine surfactants. These materials have the general formula:

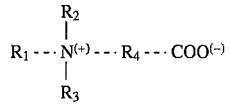

$R_1$ is an alkyl group containing from about 8 to 22 carbon atoms; $R_2$ and $R_3$ are each lower alkyl groups containing from about 1 to 5 carbon atoms, and $R_4$ is an alkylene group selected from the group consisting of methylene, propylene, butylene and pentylene. (Propionate) betaines decompose in aqueous solution and hence are not included in the liquid compositions of the instant invention).

Examples of suitable betaine compounds of this type include dodecyldimethylammonium acetate, tetradecyldimethylammonium acetate, hexadecyldimethylammonium acetate, alkyldimethylammonium acetate wherein the alkyl group averages about 14.8 carbon atoms in length, dodecyldimethylammonium butanoate, tetradecyldimethylammonium butanoate, hexadecyldimethylammonium butanoate, dodecyldimethylammonium hexanoate, hexadecyldimethylammonium hexanoate, tetradecyldiethylammonium pentanoate and tetradecyldipropylammonium pentanoate. Especially preferred betaine surfactants include dodecyldimethylammonium acetate, dodecyldimethylammonium hexanoate, hexadecyldimethylammonium acetate, and hexadecyldimethylammonium hexanoate.

Other surfactants include amine oxides, phosphine oxides, and sulfoxides. However, such surfactants are usually-high sudsing. A disclosure of surfactants can be found in published British Patent Application 2,116,199A; U.S. Pat. No. 4,005,027, Hartman; U.S. Pat. No. 4,116,851, Rupe et al; U.S. Pat. No. 3,985,668, Hartman; U.S. Pat. No. 4,271,030, Brierley et al; and U.S. Pat. No. 4,116,849, Leikhim, all of which are incorporated herein by reference.

Other desirable surfactants are the alkyl phosphonates, taught in U.S. Pat. No. 4,105,573 to Jacobsen issued Aug. 8, 1978, incorporated herein by reference.

Still other preferred anionic surfactants include the linear or branched alkali metal mono- and/or di-($C_{8-14}$) alkyl diphenyl oxide mono- and/or disulfonates, commercially available under the trade names DOWFAX® 3B-2 (sodium n-decyl diphenyloxide disulfonate) and DOWFAX® 2A-1. These and similar surfactants are disclosed in published U.K. Patent Applications 2,163,447A; 2,163,448A; and 2,164,350A, said applications being incorporated herein by reference.

BLEACH INGREDIENT

The compositions of the invention optionally contain an amount of bleach sufficient to provide the composition with from 0% to about 5%, preferably from about 0.1% to about 5.0%, most preferably from about 0.5% to about 3.0%, of available chlorine or available oxygen based on the weight of the detergent composition.

An inorganic chlorine bleach ingredient such as chlorinated trisodium phosphate can be utilized, but organic chlorine bleaches such as the chlorocyanurates are preferred. Water-soluble dichlorocyanurates such as sodium or potassium dichloroisocyanurate dihydrate are particularly preferred.

Methods of determining "available chlorine" of compositions incorporating chlorine bleach materials such as hypochlorites and chlorocyanurates are well known in the art. Available chlorine is the chlorine which can be liberated by acidification of a solution of hypochlorite ions (or a material that can form hypochlorite ions in solution) and at least a molar equivalent amount of chloride ions. A conventional analytical method of determining available chlorine is addition of an excess of an iodide salt and titration of the liberated free iodine with a reducing agent.

The detergent compositions manufactured according to the present invention can contain bleach components other than the chlorine type. For example, a peroxyacid can be added as a preformed peroxyacid, or a combination of an inorganic persalt (e.g. sodium perborate or percarbonate) and an organic peroxyacid precursor which is converted to a peroxyacid when the combination of persalt and precursor is dissolved in water. The organic peroxyacid precursors are often referred to in the art as bleach activators.

Examples of suitable organic peroxyacids are disclosed in U.S. Pat. No. 4,374,035, Bossu, issued Feb. 15, 1983; U.S. Pat. No. 4,681,592, Hardy et al, issued Jul. 21, 1987; U.S. Pat. No. 4,634,551, Burns et al, issued Jan. 6, 1987; U.S. Pat. No. 4,686,063, Burns, issued Aug. 11, 1987; U.S. Pat. No. 4,606,838, Burns, issued Aug. 19, 1986; and U.S. Pat. No. 4,671,891, Hartman, issued Jun. 9, 1987.

Examples of suitable oxygen-type bleaches and activators are disclosed in U.S. Pat. No. 4,412,934 (Chung et al), issued Nov. 1, 1983, U.S. Pat. No. 4,536,314, Hardy et al, issued August 20, 1985, U.S. Pat. No. 4,681,695, Divo issued Jul. 21, 1987, and U.S. Pat. No. 4,539,130, Thompson et al, issued Sep. 3, 1985.

OTHER OPTIONAL POLYMERS

Other polymers can be added for additional dispersancy properties and/or in the present invention's granular compositions as liquid binders.

Solutions of the film-forming polymers described in U.S. Pat. No. 4,379,080 (Murphy), issued Apr. 5, 1983, incorporated herein by reference, can be used as the liquid binder.

Suitable polymers for use in the aqueous solutions are at least partially neutralized or alkali metal, ammonium or substituted ammonium (e.g., mono-, di- or triethanolammonium) salts of polycarboxylic acids. The alkali metal, especially sodium salts are most preferred. While the molecular weight of the polymer can vary over a wide range, it preferably is from about 1000 to about 500,000, more preferably is from about 2000 to about 250,000, and most preferably is from about 3000 to about 100,000.

Other suitable polymers include those disclosed in U.S. Pat. No. 3,308,067 issued Mar. 7, 1967, to Diehl, incorporated herein by reference. Unsaturated monomeric acids that can be polymerized to form suitable polymeric polycarboxylates include acrylic acid, maleic acid (or maleic anhydride), fumaric acid, itaconic acid, aconitic acid, mesaconic acid, citraconic acid and methylenemalonic acid. The presence of monomeric segments containing no carboxylate radicals such as vinylmethyl ether, styrene, ethylene, etc. is suitable provided that such segments do not constitute more than about 40% by weight of the polymer.

Other suitable polymers for use herein are copolymers of acrylamide and acrylate having a molecular weight of from about 3,000 to about 100,000, preferably from about 4,000 to about 20,000, and an acrylamide content of less than about 50%, preferably less than about 20%, by weight of the polymer. Most preferably, the polymer has a molecular weight of from about 4,000 to about 20,000 and an acrylamide content of from about 0% to about 15%, by weight of the polymer.

Particularly preferred polyacrylates are aqueous solutions of polyacrylates with an average molecular weight in acid form of from about 1,000 to about 10,000, and acrylate/maleate or acrylate/fumarate copolymers with an average molecular weight in acid form of from about 2,000 to about 80,000 and a ratio of acrylate of maleate or fumarate segments of from about 30:1 to about 2:1. This and other suitable copolymers based on a mixture of unsaturated mono- and dicarboxylate monomers are disclosed in European Patent Application No. 66,915, published Dec. 15, 1982, incorporated herein by reference.

Other polymers useful herein include the polyethylene glycols and polypropylene glycols having a molecular weight of from about 950 to about 30,000 which can be obtained from the Dow Chemical Company of Midland, Mich. Such compounds for example, having a melting point within the range of from about 30° to about 100° C. can be obtained at molecular weights of 1450, 3400, 4500, 6000, 7400, 9500, and 20,000. Such compounds are formed by the polymerization of ethylene glycol or propylene glycol with the requisite number of moles of ethylene or propylene oxide to provide the desired molecular weight and melting point of the respective polyethylene glycol and polypropylene glycol.

The polyethylene, polypropylene and mixed glycols are conveniently referred to by means of the structural formula $$HO-(CH_2-CH_2O)_m-(CH_2-\overset{\overset{CH_3}{|}}{C}HO)_n-(\overset{\overset{CH_3}{|}}{C}H-CH_2O)_o-H$$

wherein m, n, and o are integers satisfying the molecular weight and temperature requirements given above.

Other polymers useful herein include the cellulose sulfate esters such as cellulose acetate sulfate, cellulose sulfate, hydroxyethyl cellulose sulfate, methylcellulose sulfate, and hydroxypropylcellulose sulfate. Sodium cellulose sulfate is the most preferred polymer of this group.

Other suitable polymers are the carboxylated polysaccharides, particularly starches, celluloses and alginates, described in U.S. Pat. No. 3,723,322, Diehl, issued Mar. 27, 1973; the dextrin esters of polycarboxylic acids disclosed in U.S. Pat. No. 3,929,107, Thompson, issued Nov. 11, 1975; the hydroxyalkyl starch ethers, starch esters, oxidized starches, dextrins and starch hydrolysates described in U.S. Pat No. 3,803,285, Jensen, issued Apr. 9, 1974; and the carboxylated starches described in U.S. Pat. No. 3,629,121, Eldib, issued Dec. 21, 1971; and the dextrin starches described in U.S. Pat. No. 4,141,841, McDanald, issued Feb. 27, 1979; all incorporated herein by reference. Preferred polymers of the above group are the carboxymethyl celluloses.

ENZYME STABILIZING SYSTEM

The preferred liquid enzyme containing compositions herein comprise from about 0.001% to about 10%, preferably from about 0.005% to about 8%, most preferably from about 0.01% to about 6%, by weight of an enzyme stabilizing system. The enzyme stabilizing system can be any stabilizing system which is compatible with the enzyme of the present invention. Such stabilizing systems can comprise calcium ion, boric acid, propylene glycol, short chain carboxylic acid, boronic acid, polyhydroxyl compounds and mixtures thereof.

For both granular and liquid compositions of the present invention, from 0 to about 10%, preferably from about 0.01% to about 6% by weight, of chlorine bleach scavengers can be added to prevent chlorine bleach species present in many water supplies from attacking and inactivating the enzymes, especially under alkaline conditions. While chlorine levels in water may be small, typically in the range from about 0.5 ppm to about 1.75 ppm, the available chlorine in the total volume of water that comes in contact with the enzyme during dishwashing is usually large; accordingly, enzyme stability in-use can be problematic.

Suitable chlorine scavenger anions are salts containing ammonium cations. These can be selected from the group consisting of reducing materials like sulfite, bisulfite, thiosulfite, thiosulfate, iodide, etc., antioxidants like carbamate, ascorbate, etc., organic amines such as ethylenediaminetetracetic acid (EDTA) or alkali metal salt thereof and monoethanolamine (MEA), and mixtures thereof. Other conventional scavenging anions like sulfate, bisulfate, carbonate, bicarbonate, percarbonate, nitrate, chloride, borate, sodium perborate tetrahydrate, sodium perborate monohydrate, phosphate, condensed phosphate, acetate, benzoate, citrate, formate, lactate, malate, tartrate, salicylate, etc. and mixtures thereof can also be used.

Although the preferred ammonium salts can be simply admixed with the detergent composition, they are prone to adsorb water and/or give off ammonia gas. Accordingly, it is better if they are protected in a particle like that described in U.S. Pat. No. 4,652,392, Baginski et al, which is incorporated herein by reference. The preferred ammonium salts or other salts of the specific chlorine scavenger anions can either replace the suds controlling agent or be added in addition to the suds controlling agent.

OTHER OPTIONAL INGREDIENTS

The automatic dishwashing compositions of the invention can optionally contain up to about 50%, preferably from about 2% to about 20%, most preferably less than about 4%, based on the weight of the low-foaming surfactant, of an alkyl phosphate ester suds suppressor. The phosphate esters useful herein also provide protection of silver and silver-plated utensil surfaces.

The alkyl phosphate esters have been used to reduce the sudsing of detergent compositions suitable for use in automatic dishwashing machines. The esters are particularly effective for reducing the sudsing of compositions comprising nonionic surfactants which are block polymers of ethylene oxide and propylene oxide.

Suitable alkyl phosphate esters are disclosed in U.S. Pat. No. 3,314,891, issued Apr. 18, 1967, to Schmolka et al, incorporated herein by reference.

The preferred alkyl phosphate esters contain from 16–20 carbon atoms. Highly preferred alkyl phosphate esters are monostearyl acid phosphate or monooleyl acid phosphate, or salts thereof, particularly alkali metal salts, or mixtures thereof.

The compositions of the present invention may optionally comprise certain esters of phosphoric acid (phosphate ester). Phosphate esters are any materials of the general formula:

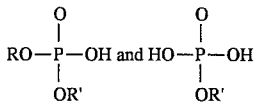

wherein R and R' are $C_6$–$C_{20}$ alkyl or ethoxylated alkyl groups. Preferably R and R' are of the general formula: alkyl-$(OCH_2CH_2)_Y$ wherein the alkyl substituent is $C_{12}$–$C_{18}$ and Y is between 0 and about 4. Most preferably the alkyl substituent of that formula is $C_{12}$–$C_{18}$ and Y is between about 2 and about 4. Such compounds are prepared by known methods from phosphorus pentoxide, phosphoric acid, or phosphorus oxy halide and alcohols or ethoxylated alcohols.

It will be appreciated that the formula depicted represent mono- and di-esters, and commercial phosphate esters will generally comprise mixtures of the mono- and di-esters, together with some proportion of tri-ester. Typical commercial esters are available under the trademarks "Phospholan" PDB3 (Diamond Shamrock), "Servoxyl" VPAZ (Servo), PCUK-PAE (BASF-Wyandotte), SAPC (Hooker). Preferred for use in the present invention are KN340N and KL340N (Hoescht) and monostearyl acid phosphate (Occidental Chemical Corp. ). Most preferred for use in the present invention is Hostophat-TP-2253 (Hoescht).

Other compounds known, or which become known, for reducing or suppressing the formation of suds can be incorporated into the compositions of the present invention. Suitable suds suppressors are described in Kirk Othmer Encyclopedia of Chemical Technology, Third Edition, Volume 7, pages 430–447 (John Wiley & Sons, Inc., 1979), U.S. Pat. No. 2,954,347, issued Sep. 27, 1960 to St. John, U.S. Pat. No. 4,265,779, issued May 5, 1981 to Gandolfo et al., U.S. Pat. No. 4,265,779, issued May 5, 1981 to Gandolfo et al. and European Patent Application No. 89307851.9, published Feb. 7, 1990, U.S. Pat. No. 3,455,839, German Patent Application DOS 2,124,526, U.S. Pat. No. 3,933,672, Bartolotta et al., and U.S. Pat. No. 4,652,392; Baginski et al., issued Mar. 24, 1987. All are incorporated herein by reference.

Filler materials can also be present including sucrose, sucrose esters, sodium chloride, sodium sulfate, potassium chloride, potassium sulfate, etc., in amounts up to about 70%, preferably from 0% to about 40%.

Liquid detergent compositions can contain water and other solvents as carriers. Low molecular weight primary or secondary alcohols exemplified by methanol, ethanol, propanol, and isopropanol are suitable. Monohydric alcohols are preferred for solubilizing surfactant, but polyols such as those containing from 2 to about 6 carbon atoms and from 2 to about 6 hydroxy groups (e.g., propylene glycol, ethylene glycol, glycerine, and 1,2-propanediol) can also be used.

A wide variety of other ingredients useful in detergent compositions can be included in the compositions hereof, including other active ingredients, carriers, hydrotropes, draining promoting agents, processing aids, corrosion inhibitors, dyes or pigments, bleach activators, etc.

Bleach-stable perfumes (stable as to odor); bleach-stable dyes (such as those disclosed in U.S. Pat. No. 4,714,562, Roselle et al, issued Dec. 22, 1987); and bleach-stable enzymes and crystal modifiers and the like can also be added to the present compositions in appropriate amounts. Other commonly used detergent ingredients can also be included.

The viscoelastic, thixotropic thickening agent in the preferred liquid compositions of the present invention is from about 0.1% to about 10%, preferably from about 0.25% to about 5%, most preferably from about 0.5% to about 3%, by weight of the detergent composition.

Preferably the thickening agent is a polymer with a molecular weight from about 500,000 to about 10,000,000, more preferably from about 750,000 to about 4,000,000.

The polymer is preferably a polycarboxylate polymer, more preferably a carboxyvinyl polymer. Such compounds are disclosed in U.S. Pat. No. 2,798,053, issued on Jul. 2, 1957, to Brown, the specification of which is hereby incorporated by reference. Methods for making carboxyvinyl polymers are also disclosed in Brown. Carboxyvinyl polymers are substantially insoluble in liquid, volatile organic hydrocarbons and are dimensionally stable on exposure to air.

Various carboxyvinyl polymers, nomopolymers and copolymers are commercially available from B. F. Goodrich Company, New York, N.Y., under the trade name Carbopol®. These polymers are also known as carbomers or polyacrylic acids. Carboxyvinyl polymers useful in formulations of the present invention include Carbopol 910 having a molecular weight of about 750,000, Carbopol 941 having a molecular weight of about 1,250,000, and Carbopols 934 and 940 having molecular weights of about 3,000,000 and 4,000,000, respectively. More preferred are the series of Carbopols which use ethyl acetate and cyclohexane in the manufacturing process, Carbopol 981, 2984, 980, and 1382.

Preferred polycarboxylate polymers of the present invention are non-linear, water-dispersible, polyacrylic acid cross-linked with a polyalkenyl polyether and having a molecular weight of from about 750,000 to about 4,000,000.

Highly preferred examples of these polycarboxylate polymers for use in the present invention are Sokalan PHC-25®, a polyacrylic acid available from BASF Corporation, the Carbopol 600 series resins available from B. F. Goodrich, and more preferred is Polygel DK available from 3-V Chemical Corporation. Mixtures of polycarboxylate polymers as herein described may also be used in the present invention.

The polycarboxylate polymer thickening agent is preferably utilized with essentially no clay thickening agents since the presence of clay usually results in a less desirable product having opacity and phase instability.

Other types of thickeners which can be used in this composition include natural gums, such as xantham gum, locust bean gum, guar gum, and the like. The cellulosic type thickeners hydroxyethyl and hydroxymethyl cellulose (ETHOCEL and METHOCEL, available from Dow Chemical) can also be used.

In the instant compositions, one or more buffering agents can be included which are capable of maintaining the pH of the compositions within the desired alkaline range. The pH of the undiluted composition ("as is") is determined at room temperature (about 20° C.) with a pH meter. It is in the low alkaline pH range that optimum performance and stability of an enzyme are realized, and it is also within this pH range wherein optimum compositional chemical and physical stability are achieved. For compositions herein containing chlorine bleach, it is the high alkaline range that optimum performance and stability is achieved.

Maintenance of the composition pH between about 7 and about 14, preferably between about 8 and about 11.5, for compositions herein containing enzymes and preferably between about 10 and about 13 for compositions herein containing chlorine. The lower pH range for enzyme containing compositions of the invention minimizes undesirable degradation of the active enzymes.

The pH adjusting agents are generally present in a level from about 0.001% to about 25%, preferably from about 0.5% to about 20% by weight of the detergent composition. These agents are preferably ingredients of the premix of step (b) of the invention.

Any compatible material or mixture of materials which has the effect of maintaining the composition pH within the pH range of about 7 to about 14, preferably about 8 to about 13, can be utilized as the pH adjusting agent in the instant invention. Such agents can include, for example, various water-soluble, inorganics salts such as the carbonates, bicarbonates, sesquicarbonates, pyrophosphates, phosphates, silicates, tetraborates, and mixtures thereof.

Examples of preferred materials which can be used either alone or in combination as the pH adjusting agent herein include sodium carbonate, sodium bicarbonate, potassium carbonate, sodium sequicarbonate, sodium pyrophosphate, tetrapotassium pyrophosphate, tripotassium phosphate, trisodium phosphate, organic amines and their salts such as monoethanol amine (MEA), anhydrous sodium tetraborate, sodium tetraborate pentahydrate, potassium hydroxide, sodium hydroxide, and sodium tetraborate decahydrate. Combinations of these pH adjusting agents, which include both the sodium and potassium salts, may be used.

The theology stabilizing agents useful in the chlorine containing liquid composition of the present invention have the formula:

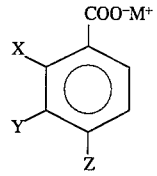

wherein each X, Y, and Z is —H, —$COO^-M^+$, —Cl, —Br, —$SO_3^-M^+$, —$NO_2$, —$OCH_3$, or a $C_1$ to $C_4$ alkyl and M is H or an alkali metal. Examples of this component include pyromellitic acid, i.e., where X, Y, and Z are —$COO^-H^+$; hemimellitic acid and trimellitic acid, i.e., where X and Y are —$COO^-H^-H^+$ and Z is —H.

Preferred rheology stabilizing agents of the present invention are sulfophthalic acid, i.e., where X is —$SO_3^-H^+$, Y is —$COO^-H^+$, and Z is —H; other mono-substituted phthalic acids and di-substituted benzoic acids; and alkyl-, chloro-, bromo-, sulfo-, nitro-, and carboxy- benzoic acids, i.e., where Y and Z are —H and X is a $C_2$ to $C_4$ alkyl, —Cl, —Br, —$SO_3^-H^+$, —$NO_2$, and —$OCH_3$, respectively.

Highly preferred examples of the rheology stabilizing agents useful in the present invention are benzoic acid, i.e., where X, Y, and Z are —H; phthalic acid, i.e., where X is —$COO^-H^+$, and Y and Z are —H; and toluic acid, where X is —$CH_3$ and Y and Z are —H; and mixtures thereof.

This theology stabilizing component is present in chlorine containing compositions in an amount of from about 0.05% to about 2%, preferably from about 0.1% to about 1.5%, most preferably from about 0.2% to about 1%, by weight, of the composition. Mixtures of the rheology stabilizing agents as described herein may also be used in the present invention.

Metal salts of long chain fatty acids and/or long chain hydroxy fatty acids have been found to be useful in automatic dishwashing detergent compositions as theological modifiers and to inhibit tarnishing caused by repeated exposure of sterling or silver-plate flatware to bleach-containing automatic dishwashing detergent compositions (U.S. Pat. No. 4,859,358, Gabriel et al). By "long chain" is meant the higher aliphatic fatty acids or hydroxy fatty acids having from about 6 to about 24 carbon atoms, preferably from about 8 to 22 carbon atoms, and more preferably from about 10 to 20 carbon atoms and most preferably from about 12 to 18, inclusive of the carbon atom of carboxyl group of the fatty acid, e.g., stearic acid, and hydroxy stearic acid. By "metal salts" of the long chain fatty acids and/or hydroxy fatty acids is meant both monovalent and polyvalent metal salts, particularly the sodium, potassium, lithium, aluminum, and zinc salts, e.g., lithium salts of the fatty acids. Specific examples of this material are aluminum, potassium, sodium, calcium and lithium stearate or hydroxy stearate, particularly preferred is aluminum tristearate. If the metal salts of long chain hydroxy fatty acids are incorporated into the automatic dishwashing detergent compositions of the present invention, this component generally comprises from about 0.01% to about 2%, preferably from about 0.05% to about 0.2% by weight of the composition.

If fatty acids are to be used in the formulation, additional processing requirements may be needed. The most common fatty acid used in conventional liquid automatic dishwashing detergents are metal salts of stearate and hydroxy-stearate, for example aluminum tristearate and sodium stearate. Similar to the polymer thickener, these materials are difficult to process and should be substantially dispersed in the product in order to function as intended. There are various methods for incorporating the fatty acid material. The first is to add the material as a powder to the batch without any special processing steps—such as any solid form builder would be added. The batch should be well mixed and observed to ensure that a dispersion has been achieved. A more preferred method is to liquify the fatty acid or dissolve it in a hot liquid mixture and then add it to the batch. The most preferred method is to use an eductor or tri-blender to add the fatty acid to the premix. This most preferred method gives the best dispersion and is the least process intensive.

An alkali metal salt of an amphoteric metal anion (metalate), such as aluminate, can be added to provide additional structuring to the polycarboxylate polymer thickening agent. See U.S. Pat. No. 4,941,988, Wise, issued Jul. 17, 1990, incorporated herein by reference.

Granular automatic dishwashing detergent composition of the present invention may contain base granules formed by an agglomeration process, which requires a liquid binder. The liquid binder can be employed in an amount from about 3% to about 45%, preferably from about 4% to about 25%, most preferably from about 5% to about 20%, by weight of the base granules. The liquid binder can be water, aqueous solutions of alkali metal salts of a polycarboxylic acid and/or nonionic surfactant described herein above.

The liquid binder of a water-soluble polymer listed above can be an aqueous solution comprising from about 10% to about 70%, preferably from about 20% to about 60%, and most preferably from about 30% to about 50%, by weight of the water-soluble polymer.

Low-foaming nonionic surfactants and the low molecular weight modified polyacrylates both described above can also be used as a liquid binder, provided they are in the liquid form or are premixed with another liquid binder.

COMPOSITION

Preferred granular and viscoelastic, thixotropic, liquid, polymer-containing detergent compositions hereof will preferably be formulated such that during use in aqueous operations, the wash water will have a pH of between about 7 and 12, preferably between about 8 and 11.

Preferred liquid compositions herein are gel and/or paste automatic dishwashing detergent compositions, more preferably gel automatic dishwashing detergent compositions.

This invention also allows for concentrated automatic dishwashing detergent compositions. By "concentrated" is meant that these compositions will deliver to the wash the same amount of active detersive ingredients at a lower dosage.

Concentrated automatic dishwashing detergent compositions herein contain about 10 to 100 weight % more active detersive ingredients than regular automatic dishwashing detergent compositions. Preferred are automatic dishwashing detergent compositions with from about 10 to 100, preferably 20 to 90, most preferably 25 to 80, weight % of active detersive ingredients.

EXAMPLE I

The following granular products were prepared:

TABLE 1

| Ingredients | % by weight A | % by weight B |
|---|---|---|
| Sodium citrate, dihydrate | 17.08 | 17.08 |
| Sodium carbonate | 20.00 | 20.00 |
| 4500 MW polyacrylate[1] (active basis) | 6.00 | — |
| 3500 MW modified polyacrylate (active basis) | — | 6.00 |
| Hydrated 2.0 ratio sodium silicate | 19.23 | 19.23 |
| Nonionic surfactant | 3.50 | 3.50 |
| Sodium sulfate | 21.23 | 21.23 |
| Sodium perborate monohydrate | 9.87 | 9.87 |
| Savinase 6.0T | 2.00 | 2.00 |
| Termamyl 60T | 1.10 | 1.10 |
| Water | - - - balance - - - | |

[1]Acusol @ 445N

Multi-cycle spotting and filming performance of Formulas A and B are evaluated using glass tumblers (6 per machine) washed for 7 cycles in General Electric and Kenmore automatic dishwashers. Product usages are 50% of the automatic dishwasher's prewash and mainwash dispenser cup volumes. 36 g of a test soil containing fat and protein are added to each machine at the beginning of the second through seventh cycles. Water hardness is 12–14 grains per gallon with a 3:1 calcium/magnesium ratio and the wash temperature is 130° F. The entire test is replicated 4 times in each type of machine and the glasses are graded separately for both spotting and filming performance against photographic standards (scale=4–9, with 4 the worst and 9 the best).

TABLE 2

| | General Electric | | Kenmore | |
|---|---|---|---|---|
| | Spotting | Filming | Spotting | Filming |
| Formula A | 7.06 | 6.79 | 6.98 | 6.00 |
| Formula B | 6.88 | 6.96 | 6.75 | 7.04 |
| LSD (.95)[1] | 0.27 | 0.20 | 0.31 | 0.15 |

[1]Least Significant Difference at 95% confidence level.

Formula B, which contains a 3500 MW modified polyacrylate copolymer, provides significantly better filming performance in the Kenmore machines than Formula A, which contains a conventional 4500 MW sodium polyacrylate homopolymer.

EXAMPLE II

Granular automatic dishwashing detergents of the present invention are as follows:

TABLE 3

| Ingredients | % by weight | | |
|---|---|---|---|
| | Formula C | Formula D | Formula E |
| BUILDERS/BUFFERS | | | |
| Sodium citrate, dihydrate | 17.00 | 20.00 | 42.50 |
| Sodium carbonate | 20.00 | 40.00 | — |
| Hydrated 2.0 ratio sodium silicate | 19.00 | 10.00 | 33.00 |
| DISPERSANT/ SURFACTANT | | | |
| 3500 MW modified poly-acrylate active basis) | 6.00 | 8.00 | 4.00 |
| Nonionic surfactant | 3.50 | 5.00 | 1.50 |
| BLEACH | | | |
| Sodium perborate | 5.00–10.00 | 5.00–15.00 | 5.00–15.00 |
| Tetraacetyl-ethylenediamine | 0.00 | 3.50 | 3.50 |
| ENZYMES | | | |
| Savinase ® 6.0T | 2.00 | 1.00–3.00 | 2.20 |
| Termamyl ® 60T | 1.10 | 0.50–1.50 | 1.50 |
| OTHER | | | |
| Perfume, dye, water and filler | - - - balance - - - | | |

EXAMPLE III

The following granular detergent products were prepared:

TABLE 4

| Ingredients | % by weight | | |
|---|---|---|---|
| | Formula F | Formula G | Formula H |
| Sodium citrate dihydrate | 17.08 | 17.08 | 17.08 |
| Sodium carbonate | 20.00 | 20.00 | 20.00 |
| 70,000 MW acrylic/maelic, copolymer[1] (active basis) | 6.00 | — | — |
| 4500 MW sodium poly-acrylate (active basis)[2] | — | 6.00 | — |
| 3500 MW modified poly-acrylate (active basis) | — | — | 6.00 |
| Hydrated 2.0 ratio sodium silicate | 27.30 | 27.30 | 27.30 |
| Nonionic surfactant[3] | 1.50 | 1.50 | 1.50 |
| Sodium sulfate | 15.07 | 15.59 | 15.07 |
| Sodium perborate monohydrate | 5.33 | 5.33 | 5.33 |
| Tetraacetyl-ethylenediamine | 3.50 | 3.50 | 3.50 |
| Savinase ® 6.0T | 2.20 | 2.20 | 2.20 |
| Termamyl 60T | 1.50 | 1.50 | 1.50 |
| Water and miscellaneous | 0.52 | 0.00 | 0.52 |

[1]Sokalan CP5
[2]Acusol ® 445N
[3]Plurafac LF 404

The multi-Cycle spotting and filming performance of Formulas F, G, and H is then evaluated under European conditions. Glass tumblers (6 per machine) were washed for 7 cycles in Miele automatic dishwashers using the Universal 65° C. warm-up cycle. Formula usages are 20 g of test product per machine per cycle. 36 g of a test soil containing fat and protein are added to each machine at the beginning of the second through seventh cycles. Water hardness is 15.0 grains per gallon with a 3:1 calcium/magnesium ratio. The entire test is replicated 4 times and the glasses are graded separately for both spotting and filming performance against photographic standards (scale=4–9, with 4 the worst and 9 the best).

TABLE 5

| | Spotting | Filming |
|---|---|---|
| Formula F | 8.50 | 6.06 |
| Formula G | 8.48 | 6.42 |
| Formula H | 8.48 | 7.02 |
| LSD[1] (.95) | 0.04 | 0.37 |

[1]Least Significant Difference calculated at the 95% confidence level.

Formula H, which contains a 3500 MW modified poly-acrylate copolymer, provides significantly better filming performance under European conditions than either Formula F, which contains a 70,000 MW acrylic/maleic copolymer or Formula G, which contains a 4500 MW polyacrylate homopolymer.

EXAMPLE IV

The following granular detergent products are prepared:

TABLE 6

| Ingredients | % by weight | |
|---|---|---|
| | Formula I | Formula J |
| Sodium citrate dihydrate | 17.08 | 17.08 |
| Sodium carbonate | 20.00 | 20.00 |
| 4500 MW sodium polyacrylate (active basis)[1] | 6.00 | — |
| 3500 MW modified polyacrylate (active basis) | — | 6.00 |
| Hydrated 2.0 ratio sodium silicate | 19.23 | 19.23 |
| Nonionic surfactant | 3.50 | 3.50 |
| Sodium sulfate | 22.02 | 22.02 |
| Sodium perborate monohydrate | 9.87 | 9.87 |
| Savinase ® 6.0 T | 1.50 | 1.50 |
| Termamyl ® 60 T | 0.80 | 0.80 |
| Water and miscellaneous | - - - balance - - - | |

[1]Acusol ® 445N

The tough food cleaning performance of Formulas I and J are evaluated using the following procedure. Samples of mozzarella cheese and cooked egg yolk are baked onto stainless steel coupons and liquified cooked spaghetti is baked onto pyrex coupons. The test coupons are then washed with the products for 15 minutes followed by a 2 minute rinse using an automatic miniature dishwasher. Product usages are 2682 ppm. Water hardness was 7 grains per gallon with a 3:1 calcium/magnesium ratio and the wash temperature was 120° F. The entire test is replicated 4 times and the percent soil removal values are determined gravimetrically.

TABLE 7

| | Percent Gravimetric Removal | | |
|---|---|---|---|
| | Cheese | Egg | Spaghetti |
| Formula I | 24.4 | 32.8 | 48.7 |
| Formula J | 30.4 | 35.7 | 58.7 |
| LSD (.90)[1] | 5.5 | 4.0 | 8.9 |

[1]Least significant difference calculated at the 90% confidence level.

Formula J, which contains a 3500 MW modified poly-acrylate copolymer, provides significantly better tough food cleaning performance than Formula I, which contains a 4500 MW sodium polyacrylate homopolymer.

EXAMPLE V

Compositions A–E, H and J of Examples I–IV are supplemented by the addition of 0.5% by weight of the sodium salt of ethane 1-hydroxy-1, 1 diphosphonic acid.

What is claimed is:

1. An automatic dishwashing detergent composition comprising by weight:

a) from about 0.01% to about 40% alkali metal silicate;

b) from about 0.1% to about 10% polyacrylate copolymer having a molecular weight of from about 1,000 to about 5,000 which contains monomer units;

(i) from about 10% to 90% of; by weight of said copolymer, of a monomer which is acrylic acid or its salt; and (ii) from about 10% to 90% by weight of a comonomer which is a substituted acrylic acid or salt of the formula

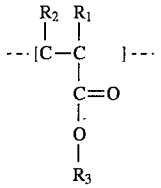

wherein $R_1$ and $R_2$ are each H, $C_{1-4}$ alkyl or hydroxyalkyl with at least one of $R_1$ and $R_2$ being $C_{1-4}$ alkyl or hydroxyalkyl and wherein $R_3$ is H, $C_{1-4}$ alkyl or hydroxyalkyl or alkali metal; and c) from about 15% to about 90% of a detergency builder selected from the group consisting of water-soluble, alkali metal, ammonium or substituted ammonium phosphates, polyphosphates, citrates, and mixtures thereof;

d) optionally about 5% to about 40% detergency builder selected from the group consisting of water-soluble, alkali metal, ammonium or substituted ammonium carbonates, bicarbonates, and mixtures thereof; and e) optionally about 0.2% to about 5% detergency builder selected from the group consisting of water-soluble, alkali metal, ammonium or substituted ammonium phosphonates, polyphosphonates, and mixtures thereof.

2. An automatic dishwashing detergent composition according to claim 1 further comprising from about 0.003% to 4% of a detersive enzyme selected from the group consisting of protease, amylase, lipase and mixtures of said enzymes.

3. An automatic dishwashing detergent composition according to claim 2 wherein said polyacrylate copolymer is from about 20% to about 80% by weight acrylic acid or its salt and from about 20% to about 80% by weight of said comonomer.

4. An automatic dishwashing detergent composition according to claim 3 further comprising from about 0.01% to about 40% low foaming detergent surfactant.

5. An automatic dishwashing detergent composition according to claim 4 wherein said detergency builder d) is present.

6. An automatic dishwashing detergent composition according to claim 4 wherein said detergency builder e) is present and includes ethane 1-hydroxy-1, 1 diphosphonic acid or its alkali metal salts.

7. An automatic dishwashing detergent composition according to claim 5 further comprising bleach sufficient to provide from about 0.1% to about 5.0% by weight available chlorine or oxygen.

8. An automatic dishwashing detergent composition according to claim 7 wherein said low foaming detergent surfactant a nonionic surfactant.

9. An automatic dishwashing detergent composition according to claim 8 comprising from about 0.005 to about 3% by weight protease or amylase.

10. An automatic dishwashing detergent composition according to claim 9 wherein said bleach is percarbonate.

11. An automatic dishwashing detergent composition according to claim 9 wherein said polyacrylate copolymer has a molecular weight of 3500 and is about 70% by weight acrylic acid and about 30% by weight methylacrylic acid.

12. A granular automatic dishwashing detergent composition according to claim 11 wherein said composition is agglomerated with from about 4% to about 25% by weight of a liquid binder selected from the group consisting of water, aqueous solutions of alkali metal salts of a polycarboxylic acid, nonionic surfactant and mixtures thereof wherein said binder is in addition to any builder and/or low foaming detergent surfactant present.

13. A granular automatic dishwashing detergent compositions according to claim 12 further comprising from about 0.01% to about 6% by weight chlorine bleach scavengers wherein said scavengers are in addition to any builder and/or polycarboxylate binder present.

14. A granular automatic dishwashing detergent composition according to claim 13 further comprising from about 0.001% to about 10% of an enzyme stabilizing system.

* * * * *